US009640116B2

(12) United States Patent
Park et al.

(10) Patent No.: US 9,640,116 B2
(45) Date of Patent: May 2, 2017

(54) HYBRID DRIVING MANNER ORGANIC LIGHT EMITTING DIODE DISPLAY APPARATUS

(71) Applicant: LG DISPLAY CO., LTD., Seoul (KR)

(72) Inventors: Jongmin Park, Anyang-si (KR); Younghwan Ahn, Paju-si (KR); Yunki Won, Incheon (KR); JoonHee Lee, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/581,143

(22) Filed: Dec. 23, 2014

(65) Prior Publication Data

US 2015/0187275 A1 Jul. 2, 2015

(30) Foreign Application Priority Data

Dec. 31, 2013 (KR) ..... 10-2013-0168590

(51) Int. Cl.

| | |
|---|---|
| ***G09G 5/10*** | (2006.01) |
| ***G09G 3/3266*** | (2016.01) |
| ***G09G 3/3258*** | (2016.01) |
| ***G09G 5/18*** | (2006.01) |
| *G09G 3/20* | (2006.01) |

(52) U.S. Cl.

CPC ..... *G09G 3/3266* (2013.01); *G09G 3/2081* (2013.01); *G09G 3/3258* (2013.01); *G09G 5/18* (2013.01); *G09G 3/2011* (2013.01); *G09G 3/2025* (2013.01); *G09G 2320/041* (2013.01); *G09G 2320/045* (2013.01); *G09G 2330/023* (2013.01)

(58) Field of Classification Search

CPC .. G09G 3/2011; G09G 3/2025; G09G 3/2081; G09G 3/3258; G09G 2320/023; G09G 2320/041; G09G 2320/045; G09G 5/18

USPC ..... 345/76, 92, 204–214, 590, 690–692; 315/172; 717/106

See application file for complete search history.

(56) References Cited

U.S. PATENT DOCUMENTS 5,748,160 A 5/1998 Shieh et al.
7,768,487 B2 * 8/2010 Jeon ..... G09G 3/3291 345/204

(Continued)

FOREIGN PATENT DOCUMENTS

CN 1658264 A 8/2005
CN 101826294 A 9/2010

(Continued)

OTHER PUBLICATIONS

Office Action dated Sep. 5, 2016 for Chinese Application No. 201410710067.4, 8 pages.

*Primary Examiner* — Prabodh M Dharia
(74) *Attorney, Agent, or Firm* — Brinks Gilson & Lione

(57) ABSTRACT

The present invention provides an organic light emitting diode (OLED) display apparatus displaying a grayscale of one frame with N number of subfields. The OLED display apparatus includes a display panel where pixels are defined by an intersection of data lines and gate lines, a gate driving unit that provides a scan signal to the gate line, and a data driving unit that controls a data voltage in an analog manner. Here, the data voltage is provided to the data line in at least one subfield.

6 Claims, 19 Drawing Sheets

(56) References Cited

U.S. PATENT DOCUMENTS

2003/0142056 A1* 7/2003 Okamoto ..... G09G 3/2007 345/90
2004/0036968 A1* 2/2004 Ito ..... G03B 21/16 359/443
2004/0145597 A1* 7/2004 Ito ..... G09G 3/3233 345/690
2004/0257359 A1* 12/2004 Muroi ..... G09G 3/3233 345/212
2005/0007392 A1* 1/2005 Kasai ..... G09G 3/2014 345/690
2005/0168417 A1 8/2005 Ha et al.
2006/0001617 A1* 1/2006 Shin ..... G09G 3/325 345/76
2006/0044245 A1* 3/2006 Park ..... G09G 3/3233 345/92
2006/0092148 A1* 5/2006 Ozawa ..... G09G 3/3233 345/204
2006/0108937 A1* 5/2006 Kim ..... G09G 3/3233 315/169.3
2006/0187148 A1* 8/2006 Kwak ..... G09G 3/2022 345/67
2006/0225034 A1* 10/2006 Peck ..... G06F 8/34 717/106
2006/0250334 A1 11/2006 Giraldo et al.
2008/0144112 A1* 6/2008 Moon ..... G09G 3/2051 358/3.03
2008/0266333 A1* 10/2008 Silverstein ..... G02B 5/201 345/691
2008/0291135 A1* 11/2008 Kim ..... G09G 3/2022 345/76
2010/0001983 A1* 1/2010 Abe ..... G09G 3/3233 345/211
2010/0117935 A1* 5/2010 Seo ..... G09G 3/2029 345/76
2010/0156874 A1* 6/2010 Jung ..... G02F 1/134363 345/211
2010/0225675 A1* 9/2010 Takahashi ..... G09G 3/3648 345/690
2012/0287144 A1* 11/2012 Gandhi ..... G09G 3/2029 345/589
2012/0320111 A1* 12/2012 Hagood, IV ..... G02B 26/004 345/690
2013/0201223 A1 8/2013 Li et al.
2013/0214261 A1 8/2013 Koyama
2014/0071176 A1* 3/2014 Kim ..... G09G 3/3225 345/690
2014/0078031 A1* 3/2014 Jang ..... G09G 3/3225 345/83
2014/0210802 A1* 7/2014 Myers ..... G09G 3/3413 345/207
2014/0267445 A1* 9/2014 Yaras ..... G09G 3/2037 345/690
2014/0292823 A1* 10/2014 Lee ..... G09G 3/3225 345/690
2014/0292826 A1* 10/2014 In ..... G09G 3/2022 345/690
2014/0354698 A1* 12/2014 Lee ..... G09G 3/3258 345/690
2015/0170572 A1* 6/2015 Qing ..... G09G 3/3225 315/172
2015/0187094 A1* 7/2015 Lee ..... G06T 5/009 345/590
2015/0187254 A1* 7/2015 Lee ..... G09G 3/2022 345/692
2015/0287355 A1* 10/2015 Cho ..... G09G 3/2074 345/691

FOREIGN PATENT DOCUMENTS

CN 101937648 A 1/2011
CN 1019 * 5/2011
CN 101937648 * 5/2011
EP 1 914 709 A1 4/2008

* cited by examiner

HYBRID DRIVING MANNER ORGANIC LIGHT EMITTING DIODE DISPLAY APPARATUS

CROSS-REFERENCE TO RELATED APPLICATION

This application claims priority from and the benefit under 35 U.S.C. §119(a) of Korean Patent Application No. 10-2013-0168590, filed on Dec. 31, 2013, which is hereby incorporated by reference for all purposes as if fully set forth herein.

BACKGROUND

1. Field of the Disclosure

The present disclosure relates to a hybrid driving manner Organic Light Emitting Diode (OLED) display apparatus.

2. Description of the Prior Art

An Organic Light Emitting Diode (OLED) display apparatus that has come into the spotlight as a display apparatus has advantages of a fast response rate, high light emitting efficiency, high luminance and a wide viewing angle because of using an OLED which emits light by itself.

FIGS. 1A and 1B are views illustrating a characteristic of a driving transistor driving the OLED in the OLED display apparatus. FIG. 1A illustrates a structure of the driving transistor DT connected to the organic light emitting diode OLED, and FIG. 1B illustrates a saturation curve of a drain-source current Ids of the driving transistor DT.

Referring to FIG. 1A, the driving transistor DT is connected to the organic light emitting diode OLED. The display apparatus controls the drain-source current Ids flowing to the organic light emitting diode OLED by controlling a gate-source voltage Vgs of the driving transistor DT.

At this time, a drain-source voltage Vds should be maintained in a level equal to or higher than a certain level in order to flow the drain-source current Ids to the driving transistor DT, and to this end, a conventional display apparatus inputs a high potential voltage VDD having a certain level to a drain terminal (D) of the driving transistor DT.

Some problems in a case where the conventional display apparatus provides the high potential voltage VDD having the certain level to the driving transistor DT are described with reference to the FIG. 1B.

Referring to FIG. 1B, since the display apparatus drives the driving transistor DT in a saturation region, in order to provide a drain-source current of Ids_a ampere (A) to the OLED, the display apparatus provides Vgs_a volt (V) as the gate-source voltage and also provides the drain-source voltage Vds higher than a drain-source voltage Vds_a of a saturation point Pa1. In the same manner, in order to provide a drain-source current of Ids_b A to the OLED, the display apparatus provides Vgs_b V as the gate-source voltage and also provides the drain-source voltage Vds higher than a drain-source voltage Vds_b of a saturation point Pb1.

The drain-source voltage Vds of the driving transistor DT is determined by the high potential voltage VDD provided to the drain terminal (D) of the driving transistor DT. The conventional display apparatus provides a fixed high potential voltage VDD capable of providing the drain-source voltage equal to or higher than a saturation point in correspondence to a highest drain-source current, in order to provide the drain-source voltage Vds equal to or higher than a certain level in correspondence to all of drain-source currents Ids having several levels.

In FIG. 1B, the highest drain-source current is Ids_a A, and the display apparatus sets the high potential voltage VDD so that the drain-source voltage Vds is higher than the drain-source voltage Vds_a of the saturation point Pa1. The saturation point of the driving transistor DT may be changed according to a characteristic such as a temperature and so on, and thus the display apparatus provides the drain-source voltage in consideration of a certain margin. In FIG. 1B, the display apparatus provides a drain-source voltage Vds_m corresponding to the saturation point Pa2.

Since the high potential voltage VDD is fixed with one level in the conventional display apparatus, when the drain-source voltage is determined as Vds_m V, the display apparatus drives the driving transistor DT at a point Pb2 with respect to the drain-source current.

But, when the display apparatus drives the driving transistor DT at the point Pb2 as described above, power may be excessively dissipated in a corresponding state.

The same levels of drain-source currents Ids are provided to the OLED at the points Pb1 and Pb2, and a drain-source voltage difference is generated between the point Pb2 and the point Pb1. Here, the drain-source voltage difference is Vsur V. Loss of the driving transistor DT is determined by a product of multiplication between the drain-source current Ids and the drain-source voltage Vds as noted from the following equation 1.

$$\text{Loss of driving transistor } DT = \text{drain-source current } Ids * \text{drain-source voltage } Vds \quad \text{[Equation 1]}$$

According to equation 1, the loss of the driving transistor DT at the point Pb2 is larger than the loss of the driving transistor DT at the point Pb1. Here, the loss difference between the Pb2 and the Pb1 is Ids_b A*Vsur V.

The power dissipated in the driving transistor, firstly, generates a problem of increasing power consumption of the OLED display apparatus. In addition, such a loss generated in the driving transistor DT generates heat, and thus the loss, secondly, generates a problem of shortening life expectancy of the driving transistor DT.

The reason why the conventional display apparatus generates the above-mentioned loss in the driving transistor DT by fixing the high potential voltage VDD is because the conventional display apparatus performs a single frame driving manner. The one high potential voltage VDD is used in one frame, and since the conventional display apparatus drives all pixels in the single frame driving manner, the above-mentioned problems are incurred.

SUMMARY

An organic light emitting diode (OLED) display apparatus displaying a grayscale of one frame with N (N is a natural number larger than 2) number of subfields. The OLED display apparatus includes: a display panel where pixels are defined by an intersection of data lines and gate lines; a gate driving unit that provides a scan signal to the gate line; and a data driving unit that controls a data voltage in an analog manner. Here, the data voltage is provided to the data line in at least one subfield.

As described above, according to the present invention, there is an effect of displaying one frame with a plurality of subfields. In addition, there is an effect of lowering power consumption of an organic light emitting diode display apparatus by providing a high potential voltage or a low potential voltage differently according to each of subfields. In addition, there is an effect of driving an organic light emitting diode display apparatus in a hybrid driving manner by controlling a data voltage of a driving transistor in an analog manner in a subfield.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1B:
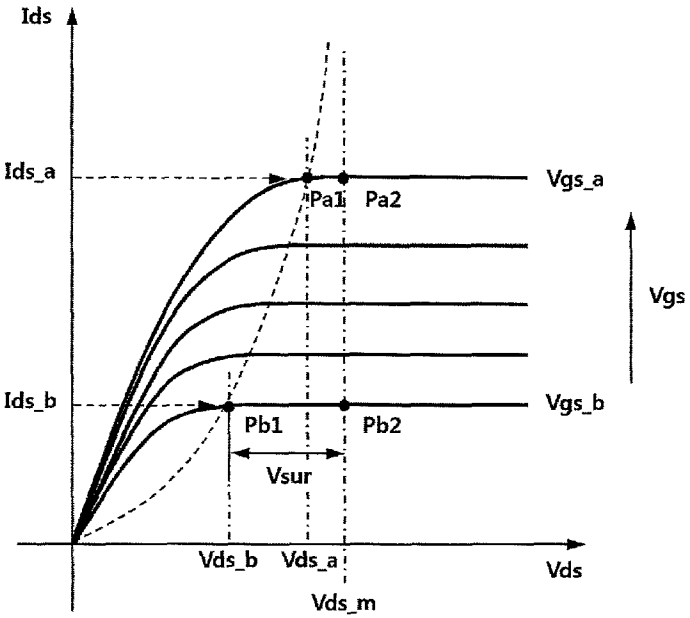
FIGS. 1A and 1B are views illustrating a characteristic of a driving transistor driving an organic light emitting diode (OLED) in an OLED display apparatus.
Figure 1A:
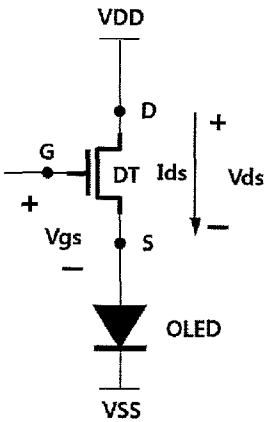

Hereinafter, exemplary embodiments of the present invention will be described with reference to the accompanying drawings. In the following description, the same elements will be designated by the same reference numerals although they are shown in different drawings. Further, in the following description of embodiments of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may be directly connected, coupled or joined to the second component. Likewise, when it is described that a certain element is formed "on" or "under" another element, it should be understood that the certain element may be formed either directly or indirectly via a still another element on or under another element.

Figure 2:
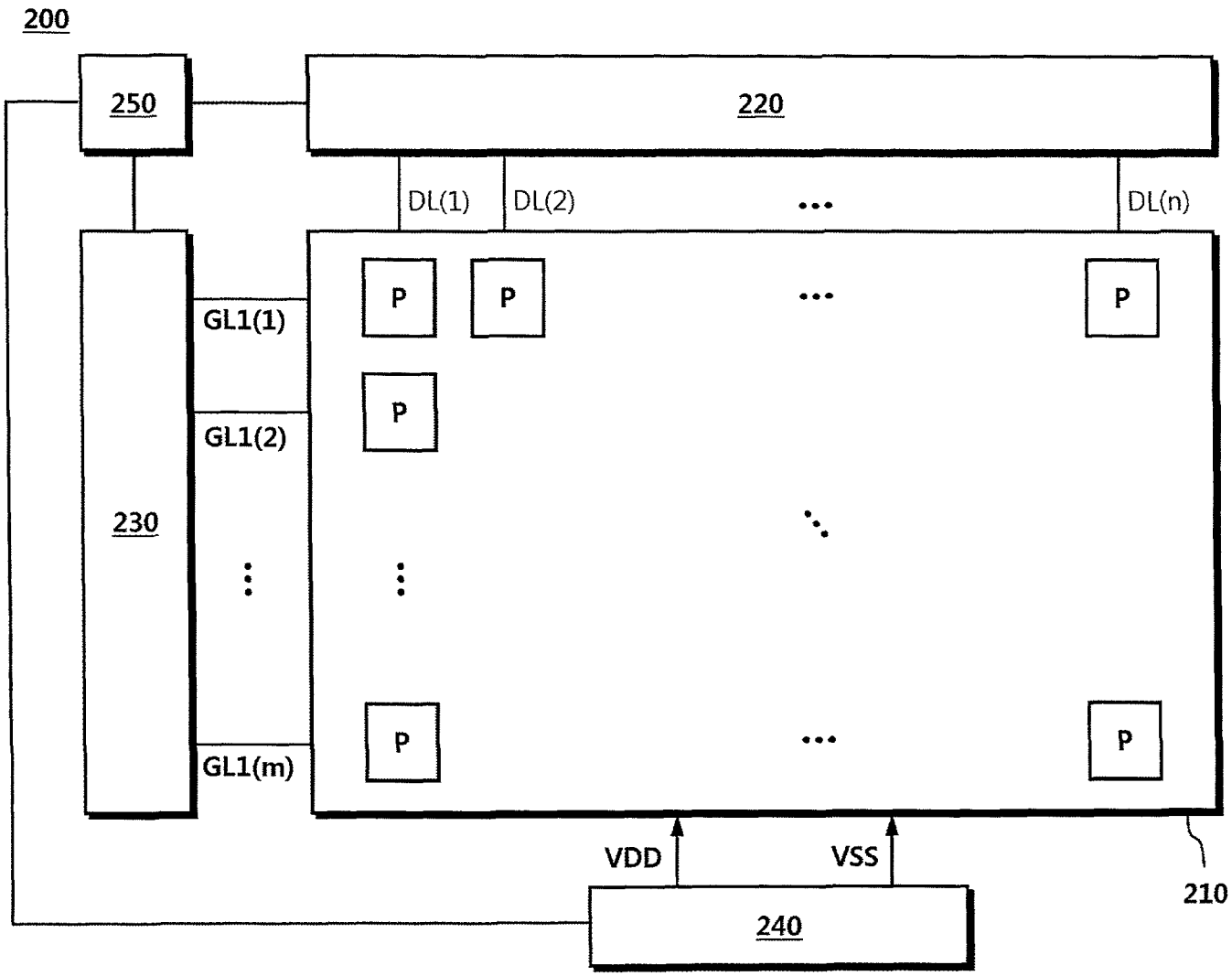
FIG. 2 is a schematic view illustrating a display apparatus to which exemplary embodiments may be applied.

FIG. 2 is a schematic view illustrating a display apparatus to which exemplary embodiments may be applied.

Referring to FIG. 2, an Organic Light Emitting Diode (OLED) display apparatus (hereinafter, referred to as "display apparatus") 200 includes a display panel 210, a data driving unit 220, a gate driving unit 230, a power supplying unit 240, a timing controller 250, etc.

In the display panel 210, data lines DL(1), DL(2), . . . , and DL(n) and gate lines GL(1), GL(2), . . . , and GL(m) are formed. A plurality of pixels P are formed by intersections of the formed data lines DL(1), DL(2), . . . , and DL(n) and the gate lines GL(1), GL(2), . . . , and GL(m).

The data driving unit 220 provides a data voltage to the data lines DL(1), DL(2), . . . , DL(n).

The gate driving unit 230 sequentially provides a scan signal to the gate lines GL(1), GL(2), . . . , and GL(m).

The power supplying unit 240 provides a high potential voltage VDD and a low potential voltage VSS to the pixels.

The timing controller 250 controls driving timings of the data driving unit 220, the gate driving unit 230 and the power supplying unit 240, and outputs various control signals for controlling the driving timings.

The gate driving unit 230 may be positioned on only one side of the display panel 210 as illustrated in FIG. 2 or may be divided into two and positioned on both sides of the display panel 210, depending on a driving manner of the gate driving unit 230. In addition, the gate driving unit 230 may include a plurality of gate driving integrated circuits (ICs). The plurality of gate driving ICs may be connected to a bonding pad of the display panel 210 in a Tape Automated Bonding (TAB) manner or a Chip On Glass (COG) manner. Alternatively, the plurality of gate driving ICs may be directly formed on the display panel 210 in a Gate In Panel (GIP) type.

The data driving unit 220 may include a plurality of date driving ICs (may be referred to as source driving IC). The plurality of data driving ICs may be connected to a bonding pad of the display panel 210 in the TAB manner or the COG manner. Alternatively the plurality of data driving ICs may be directly formed on the display panel 210 in the GIP type.

Each of the pixels P is connected to the data line DL, the gate line GL, etc. A structure of each of the pixels P is described in more detail with reference to FIG. 3.

Figure 3:
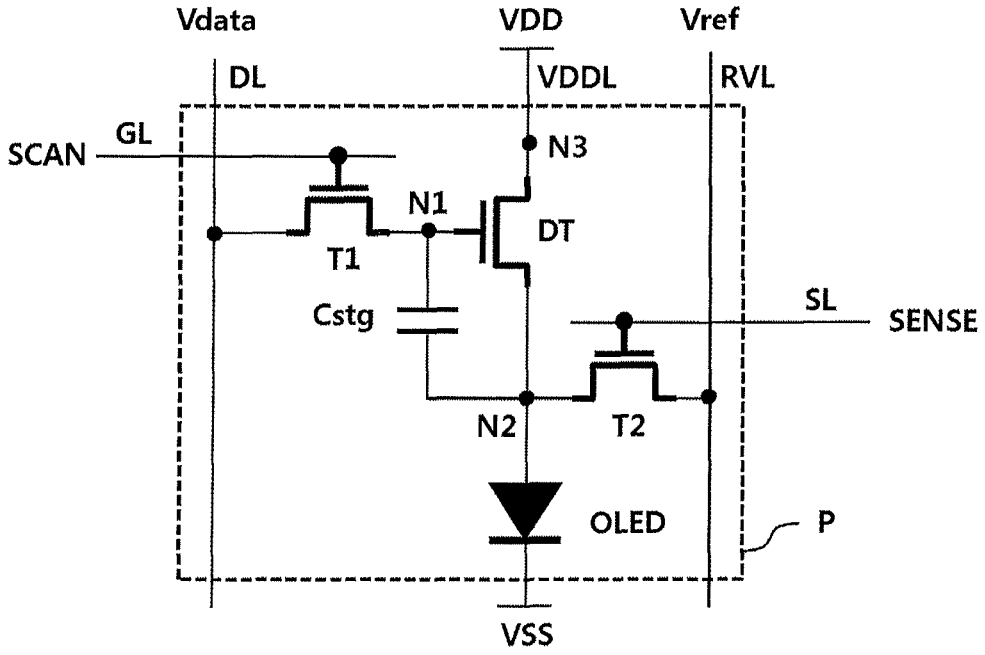
FIG. 3 is an equivalent circuit diagram illustrating one pixel P of the OLED display apparatus 200 in FIG. 2.

FIG. 3 is an equivalent circuit diagram illustrating one pixel P of the display apparatus 200 in FIG. 2.

Referring to FIG. 3, one pixel P of the display apparatus 200 includes an organic light emitting diode OLED and a driving circuit unit for driving the organic light emitting diode.

Referring to FIG. 3, the driving circuit for driving the organic light emitting diode OLED in each of the pixels P basically includes a driving transistor DT for providing an electric current to the organic light emitting diode OLED, a first transistor T1 which plays a role of a switching transistor which is controlled according to the scan signal and is capable of controlling an application of the data voltage to a first node N1 of the driving transistor DT so as to turn on or off the driving transistor DT, and a storage capacitor Cstg playing a role of maintaining the data voltage applied to the first node N1 of the driving transistor DT. The driving circuit may further include a second transistor D2 which plays a role of a sensing transistor for sensing a threshold voltage of the driving transistor DT.

Referring to FIG. 3, a connecting relation of three transistors DT, T1 and T2 and one capacitor Cstg will be described.

Referring to FIG. 3, the driving transistor DT has three nodes N1, N2 and N3 as a transistor for driving the organic light emitting diode OLED. The first node N1 of the driving transistor DT is connected to the first transistor T1, the second node N2 of the driving transistor DT is connected to an anode (or a cathode) of the organic light emitting diode OLED, and the third node N3 of the driving transistor DT is connected to a high potential voltage line VDDL to which a high potential voltage VDD is provided.

The first transistor T1 is controlled by the scan signal SCAN provided from the gate line GL. The first transistor T1 is connected between the data line DL and the first node N1 of the driving transistor DT. The first transistor T1 applies a data voltage Vdata provided from the data line DL to the first node N1 of the driving transistor DT.

The second transistor T2 is controlled by a sense signal SENSE provided from a sense line SL, and is connected between a Reference Voltage Line (RVL) to which a reference voltage Vref is provided and the second node N2 of the driving transistor DT.

The storage capacitor Cstg is connected between the first node N1 and the second node N2 of the driving transistor DT.

According to an exemplary embodiment, the driving transistor DT may be an N type transistor or a P type transistor. If the driving transistor DT is the N type transistor, the first node N1 may be a gate node, the second node N2 may be a source node, and the third node N3 may be a drain node. If the driving transistor DT is the P type transistor, the first node N1 may be a gate node, the second node N2 may be a drain node, and the third node N3 may be a source node. In the description and drawings according to the exemplary embodiment, for convenience of description, the driving transistor DT, and the first and second transistors T1 and T2 connected to the driving transistor DT are illustrated as the N type transistor. Accordingly, it is described that the first node N1 of the driving transistor DT is the gate node, the second node N2 of the driving transistor DT is the source node, and the third node N3 of the driving transistor DT is the drain node.

Meanwhile, the display apparatus 200 divides one frame into N (N is a natural number larger than 2) number of subfields to drive the one frame. The N number of subfields are added and thus a grayscale of the one frame is displayed.

As one manner for displaying one frame with the plurality of subfields, there is a digital driving manner. In the digital driving manner, the plurality of subfields are collected and thus the grayscale of the one frame is displayed. For example, when an image is displayed with 32 grayscales, one frame may be divided into 5 subfields, and the display apparatus sets a weighted value (e.g. a binary weight) of a corresponding subfield by controlling a light-emitting period in each of the subfields. For example, the display apparatus may set each of the subfields so that the weighted values are 1, 2, 4, 8 and 16 according to an antilogarithm of 2, after the manner of setting the weighted value of a first subfield as 1 and setting the weighted value of a second subfield as 2. The display apparatus displays the grayscale of the one frame by combining the subfields of which the weighted values are differently set according to the above-mentioned light-emitting period. For example, in order to display a grayscale of 23, the display apparatus controls to turn on subfields of which the weighted values are 1, 2, 4 and 16 (1+2+4+16=23) and to turn off a subfield of which the weighted value is 8. In such a digital driving manner, luminances of the OLED in each of the subfields are the same and lengths of the light-emitting periods in each of the subfields are different.

The display apparatus 200 according to an exemplary embodiment of the present specification controls the OLED in an analog manner in each of the subfields. The analog control manner is similar to the digital driving manner in view of the fact that each of the subfields are turned on or off, but is similar to an analog driving manner in view of the fact that a luminance of the OLED is controlled by the data voltage instead the OLED is fixed with a fixed luminance. In view of these two aspects, it may be expressed that the display apparatus 200 according to an exemplary embodiment of the present specification is driven in a hybrid manner, but the present invention is not limited to such a name.

A first exemplary embodiment of the hybrid driving manner is described with reference to FIGS. 4 to 7.

Figure 4:
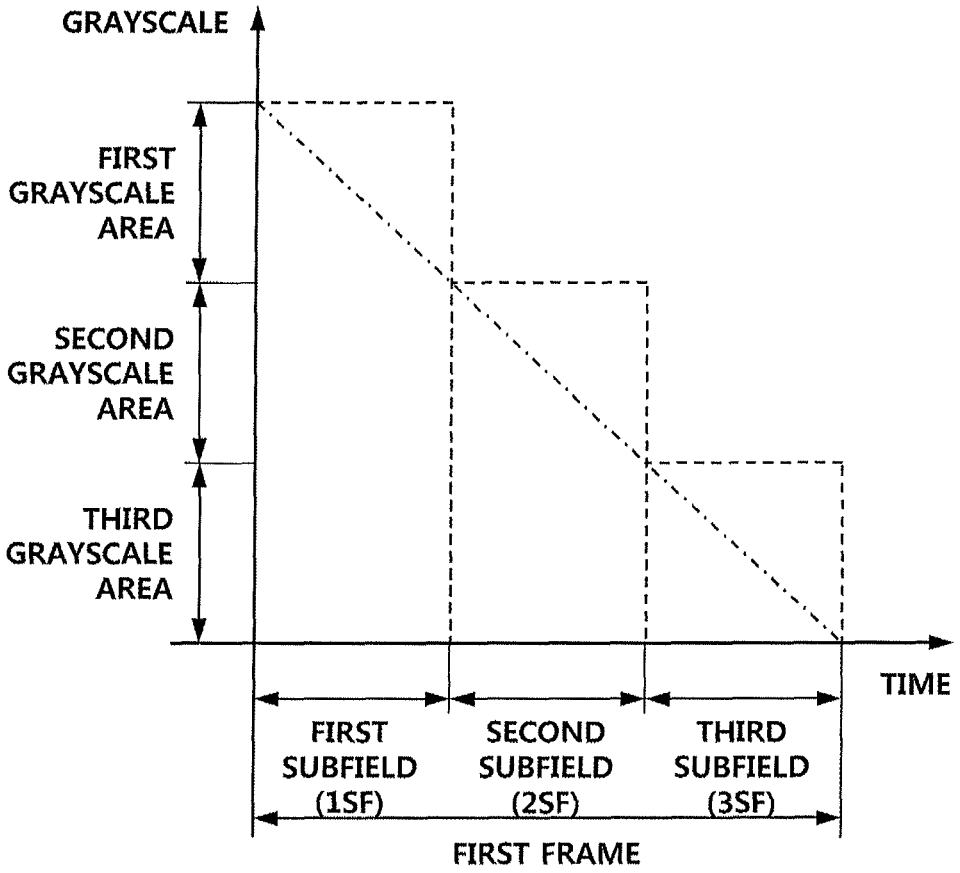
FIG. 4 is a view illustrating a grayscale area in each of the subfields in a first exemplary embodiment.

FIG. 4 is a view illustrating a grayscale area in each of the subfields in the first exemplary embodiment.

Referring to FIG. 4, the one frame is divided into three subfields.

In addition, the grayscale areas displayed in the subfields respectively are different from each other. The display apparatus 200 displays a grayscale value corresponding to a first grayscale area in a first subfield 1SF, displays a grayscale value corresponding to a second grayscale area in a second subfield 2SF, and displays a grayscale value corresponding to a third grayscale area in a third subfield 3SF.

The three grayscale areas are successively disposed. The second grayscale area is positioned successively to the third grayscale area, and the first grayscale area is positioned successively to the second grayscale area. Thus, the display apparatus 200 may display all of the grayscale values corresponding to the first to third grayscale areas by turning on any one of the subfields. When a number of the subfields is N by normalizing the number of the subfields, the display apparatus 200 may display all of the grayscale areas by turning off at least (N−1) number of subfields. Here, when the N number of subfields are turned off, a black is displayed.

Figures 5A, 5B, 5C:
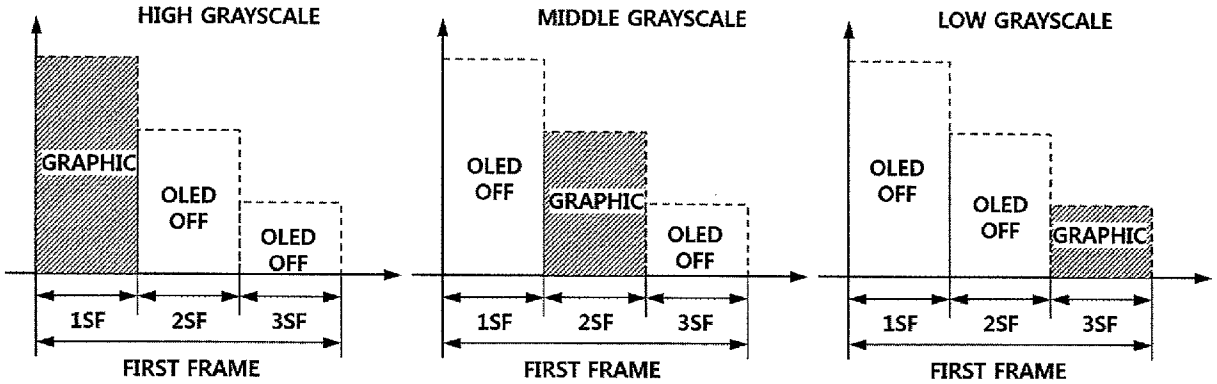
FIGS. 5A, 5B and 5C are views illustrating a driving in each of the subfields in the first exemplary embodiment.

FIGS. 5A, 5B and 5C are views illustrating a driving in each of the subfields in the first exemplary embodiment.

Referring to FIG. 5A, in order to display a high grayscale, the display apparatus 200 displays a graphic with only the first subfield 1SF displaying the first grayscale area, and turns off other subfields 2SF and 3SF. At this time, in order to turn off the subfield, the data driving unit 220 may provide a black data voltage to a corresponding data line. Alternatively, in order to turn off the subfield, the power supplying unit 240 may not provide the high potential voltage or the low potential voltage.

In addition, referring to FIG. 5B, in order to display a middle grayscale, the display apparatus 200 displays the graphic with only the second subfield 2SF displaying the second grayscale area, and turns off other subfields 1SF and 3SF. In addition, referring to FIG. 5C, in order to display a low grayscale, the display apparatus 200 displays the graphic with only the third subfield 3SF displaying the third grayscale area, and turns off other subfields 1SF and 2SF.

At this time, in the subfield displaying the graphic, the data driving unit 220 controls the grayscale value by controlling the data voltage provided to the data line in an analog manner. For example, when the display apparatus 200, displays a specific grayscale value of the high grayscale, the display apparatus 200 displays the graphic with only the first subfield 1SF, at this time, the data driving unit 220 enables the corresponding grayscale value to be displayed in the first subfield 1SF by providing a data voltage corresponding to a corresponding grayscale value in a gamma curve table to the driving transistor DT. Gamma curve tables different from each other may exist in correspondence to each of the subfields.

Figure 6:
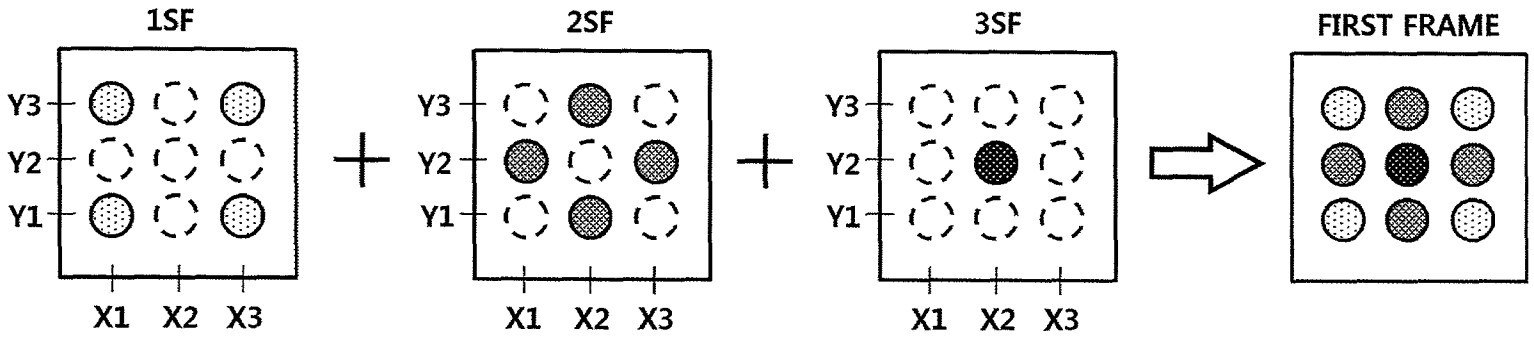
FIG. 6 is a view illustrating a driving the plurality of pixels in each of the subfields in the first exemplary embodiment.

FIG. 6 is a view illustrating a driving of the plurality of pixels in each of the subfields in the first exemplary embodiment.

Referring to FIG. 6, the first subfield 1SF is a subfield displaying the high grayscale, and the display apparatus 200 drives only (X1, Y1), (X1, Y3), (X3, Y1) and (X3, Y3) pixels displaying the high grayscale among 9 pixels. The second subfield 2SF is a subfield displaying the middle grayscale, and the display apparatus 200 drives only (X1, Y2), (X2, Y1), (X2, Y3) and (X3, Y2) pixels displaying the middle grayscale among the 9 pixels. In addition, the third subfield 3SF is a subfield displaying the low grayscale, and the display apparatus 200 drives only (X2, Y2) pixel displaying the low grayscale among the 9 pixels. The above-mentioned three subfields are added and thus a screen of the one frame is completed.

Figure 7:
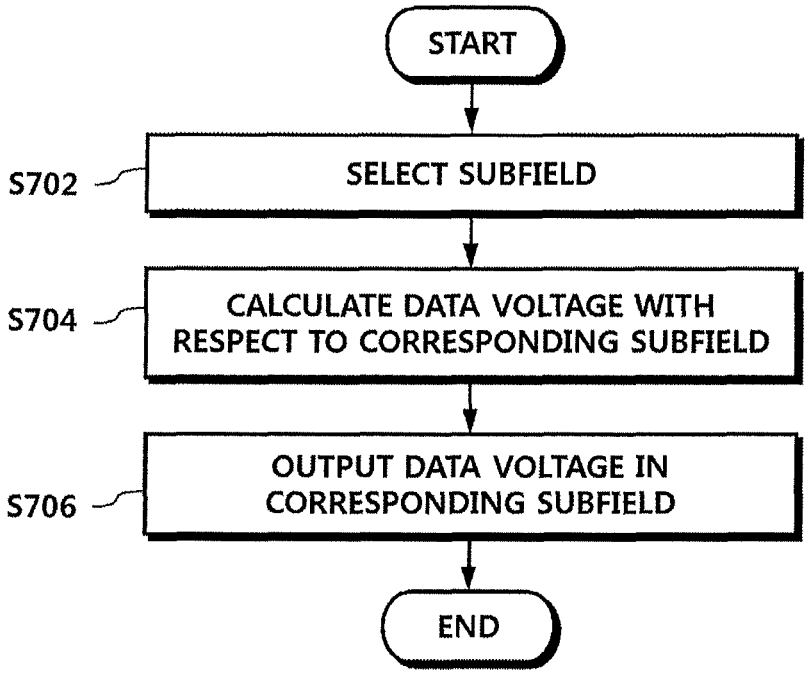
FIG. 7 is a flowchart illustrating a hybrid driving manner according to the first exemplary embodiment.

FIG. 7 is a flowchart illustrating the hybrid driving manner according to the first exemplary embodiment.

Referring to FIG. 7, the display apparatus 200 selects the subfield displayed according to the grayscale area including the grayscale value of the image (S702). For example, referring to FIG. 4, when the grayscale value of the image is the high grayscale, the first subfield 1SF is selected, when the grayscale value of the image is the middle grayscale, the second subfield 2SF is selected, and when the grayscale value of the image is the low grayscale, the third subfield 3SF is selected. Next, the display apparatus 200 calculates the data voltage corresponding to the corresponding grayscale value in the corresponding subfield through the gamma curve table (S704). Step S702 and Step S704 may be performed by a configuration element of the display apparatus 200, and according to an exemplary embodiment, the timing controller 250 may be the configuration element performing the above-mentioned steps.

When the subfield to be output and the data voltage are determined, the display apparatus 200 selects the subfield in which the data voltage is output, and may output the data voltage in the corresponding subfield (S706). In step S706, the timing controller 250 outputs an SF_Vsync signal controlling a timing of each of the subfields, and the gate driving unit 230 may provide the scan signal and the data driving unit 220 may provide the data voltage according to the SF_Vsync signal.

A second exemplary embodiment of the hybrid driving manner is described with reference to FIGS. 8 to 10.

Figure 8:
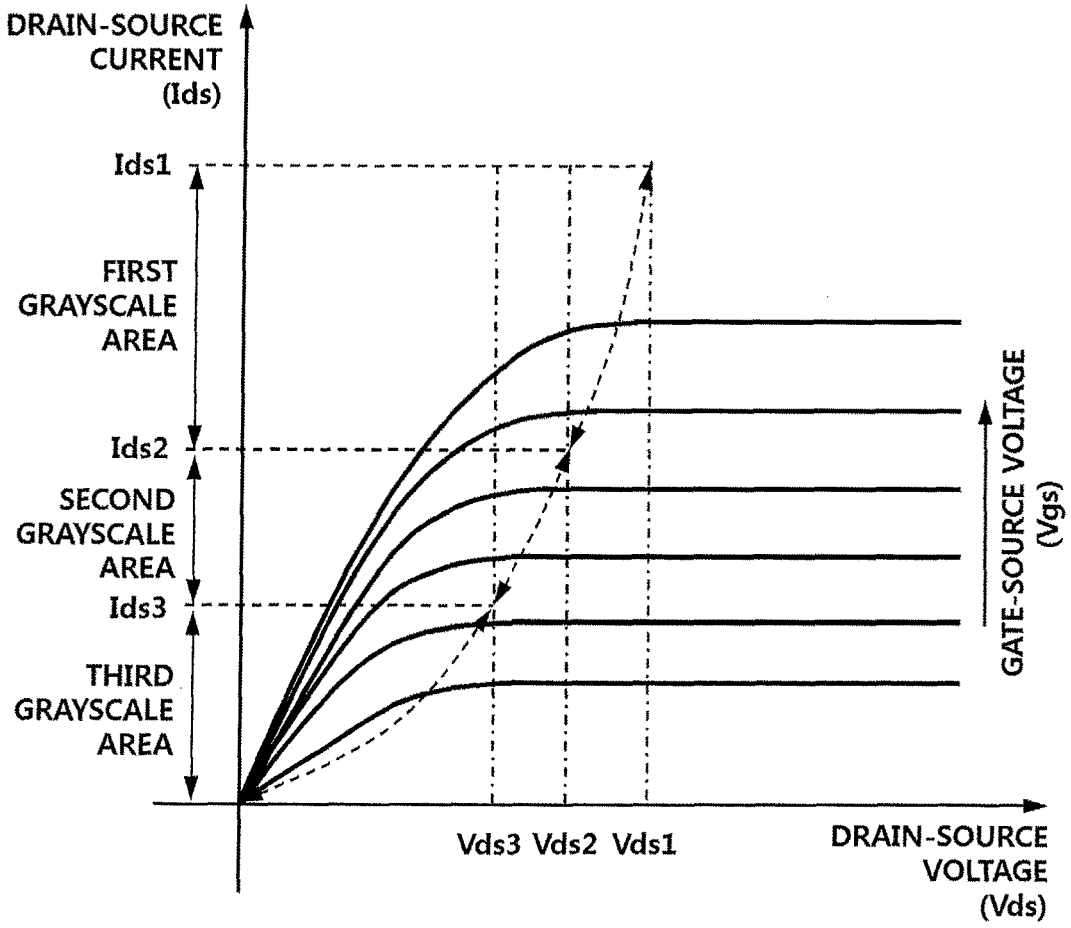
FIG. 8 is a view for describing a drain-source voltage control in a second exemplary embodiment.

FIG. 8 is a view for describing a drain-source voltage control in the second exemplary embodiment. In FIG. 8, the grayscale areas displayed in each of the subfields are displayed in a characteristic curve of the driving transistor DT.

Referring to FIG. 8, the display apparatus 200 should provide a drain-source current corresponding to Ids2 ampere (A) to Ids1 A in order to display the first grayscale area, provide a drain-source source current corresponding to Ids3 A to Ids2 A in order to display the second grayscale area, and provide a drain-source current equal to or smaller than the Ids3 A in order to display the third grayscale area.

At this time, the display apparatus 200 may set a drain-source voltage Vds differently according to each of the subfields. For example, the display apparatus 200 may set the drain-source voltage Vds of the first subfield 1SF as Vds1 volt(V) in order to display the first grayscale area, may set the drain-source voltage Vds of the second subfield 2SF as Vds2 V in order to display the second grayscale area, and may set the drain-source voltage Vds of the third subfield 3SF as Vds3 V in order to display the third grayscale area. The higher the drain-source voltage Vds is, the larger a loss in the driving transistor DT is, and thus the display apparatus 200 provides the drain-source voltage differently according to each of the grayscale areas as described above.

The display apparatus 200 provides the drain-source voltage Vds so that the driving transistor DT connected to the organic light emitting diode OLED is driven in a saturation area, and controls to decrease the drain-source voltage Vds in order to decrease a loss of the driving transistor DT. The drain-source voltage Vds with respect to each of the grayscale areas displayed in FIG. 8 set a saturation point of a drain-source current so that the drain-source voltage Vds has the smallest value in the saturation area, but the display apparatus 200 may set the drain-source voltage Vds by adding a certain margin. But, also at this time, the drain-source voltage Vds is set so that the drain-source voltage Vds with respect to the grayscale area having the low grayscale value is lower than the drain-source voltage Vds with respect to the grayscale area having the high grayscale value.

Figure 9:
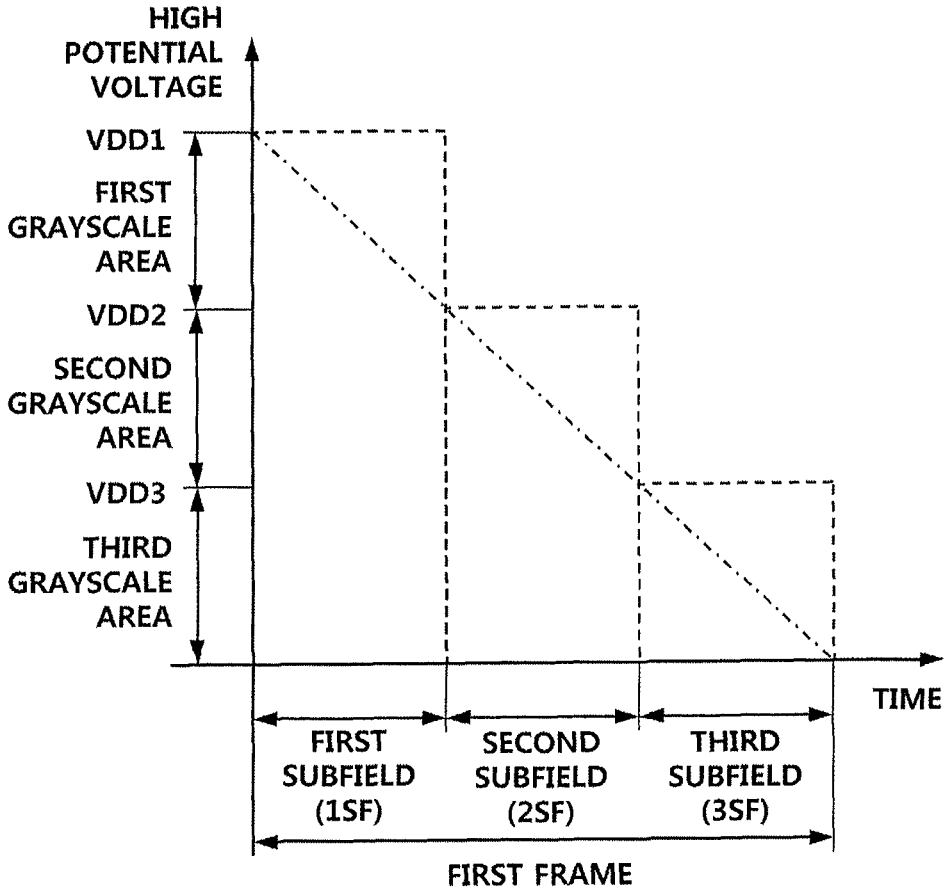
FIG. 9 is a view for describing a high potential voltage control in the second exemplary embodiment.

FIG. 9 is a view for describing a high potential voltage control in a second exemplary embodiment.

The drain-source voltage Vds described in FIG. 8 may be substantially determined according to the high potential voltage VDD in display apparatus 200. That is, the display apparatus 200 may provide a higher drain-source voltage Vds by providing a higher high potential voltage VDD, and may provide a lower drain-source voltage Vds by providing a lower high potential voltage VDD.

Referring to FIG. 9, the display apparatus 200 provides the high potential voltage VDD in the subfields of which the grayscale areas are different in different levels. The display apparatus 200 provides a first high potential voltage VDD1 having a highest level to the first subfield 1SF displaying the first grayscale area, provides a second high potential voltage VDD2 having a middle level to the second subfield 2SF displaying the second grayscale area, and provides a third high potential voltage VDD3 having a lowest level to the third subfield 3SF displaying the third grayscale area.

The high potential voltage is provided by the power supplying unit 240, and in describing the above from the perspective of the power supplying unit 240, the power supplying unit 240 may provide the high potential voltage VDD in different levels in the subfields of which the displayed grayscale areas are different. In addition, the power supplying unit 240 provides the high potential voltage VDD so that the driving transistor DT connected to the organic light emitting diode OLED is driven in the saturation area, and at this time, may control to lower the drain-source voltage Vds of the driving transistor DT. In addition, when the grayscale value of the area displayed in the first subfield 1SF is higher than that of the area displayed in the second subfield 2SF, the power supplying unit 240 may provide the high potential voltage VDD so that the drain-source voltage Vds of the driving transistor DT in the second subfield 2SF is lower than the drain-source voltage Vds of the driving transistor DT in the first subfield 1SF.

The power supplying unit 240 may control the low potential voltage VSS, and thus the power supplying unit 240 may adjust the drain-source voltage Vds by controlling the low potential voltage VSS. A value of the drain-source voltage Vds may be changed by controlling a voltage of a drain (D) terminal or a voltage of a source (S) terminal, and therefore, all of the exemplary embodiments related to controlling the high potential voltage VDD may be applied to exemplary embodiments controlling the low potential voltage VSS.

Figure 10:
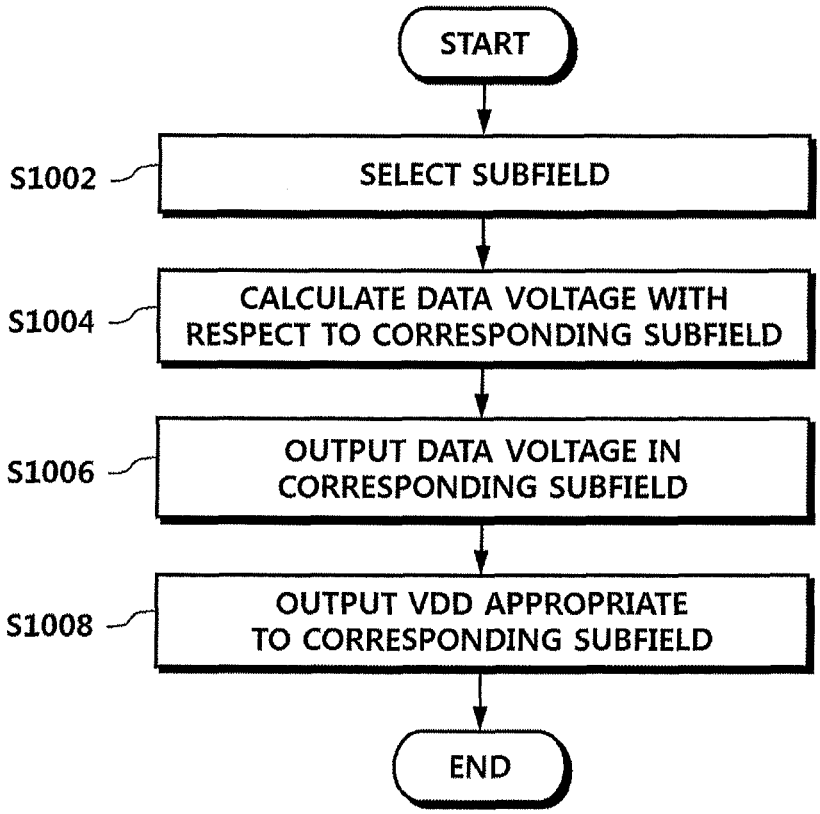
FIG. 10 is a flowchart illustrating the hybrid driving manner according to the second exemplary embodiment.

FIG. 10 is a flowchart illustrating the hybrid driving manner according to the second exemplary embodiment.

Referring to FIG. 10, the display apparatus 200 selects the subfield displayed according to the grayscale area including the grayscale value of the image (S1002). For example, referring to FIG. 9, when the grayscale value of the image is the high grayscale, the first subfield 1SF is selected, when the grayscale value of the image is the middle grayscale, the second subfield 2SF is selected, and when the grayscale value of the image is the low grayscale, the third subfield 3SF is selected. Next, the display apparatus 200 calculates the data voltage corresponding to the corresponding grayscale value in the corresponding subfield through the gamma curve table (S1004). Step S1002 and Step S1004 may be performed by a configuration element of the display apparatus 200, and according to an exemplary embodiment, the timing controller 250 may be the configuration element performing the above-mentioned steps.

When the subfield to be output and the data voltage are determined, the display apparatus 200 selects the subfield in which the data voltage is output, and may output the data voltage in the corresponding subfield (S1006). Next, the display apparatus 200 provides the high potential voltage VDD corresponding to the grayscale area of the corresponding subfield (S1008).

In step S1006 and step s1008, the timing controller 250 outputs an SF_Vsync signal controlling a timing of each of the subfields, and the gate driving unit 230 may provide the scan signal and the data driving unit 220 may provide the high potential voltage VDD according to the SF_Vsync signal.

A first exemplary embodiment of the hybrid driving manner is described with reference to FIGS. 11A, 11B, 11C and 12.

Figure 11A:
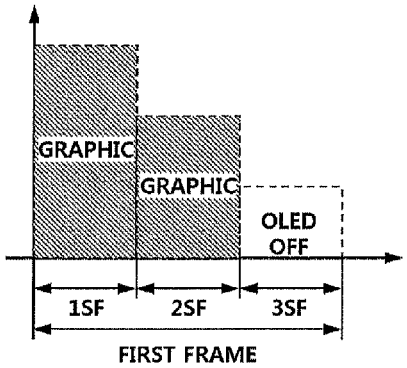
FIGS. 11A, 11B and 11C are views illustrating a subfield driving in a third exemplary embodiment.
Figure 11B:
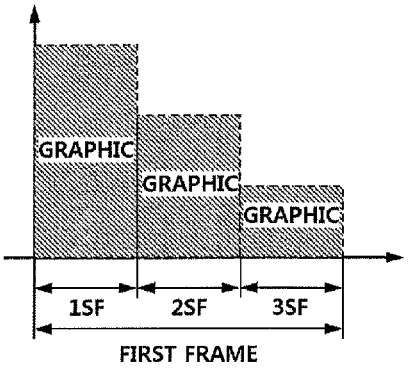
Figure 11C:
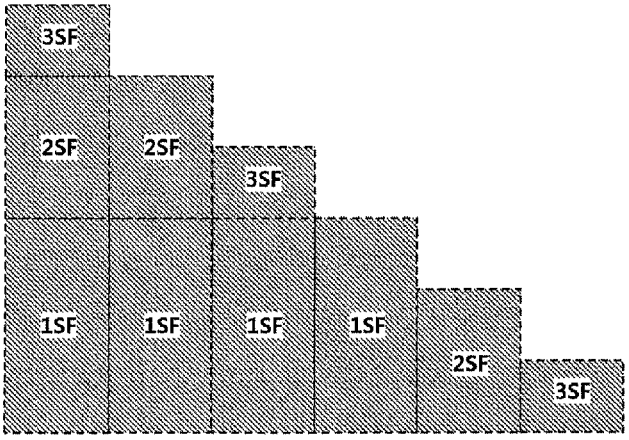

FIGS. 11A, 11B and 11C are views illustrating a subfield driving in the third exemplary embodiment.

Referring to FIGS. 11A and 11B, the display apparatus 200 displays the graphic in at least one subfield differently from the first exemplary embodiment. As described above, when the grayscale is displayed in the plurality of subfields, a total of 6 grayscale areas may be displayed as shown in FIG. 11C. When the display apparatus 200 drives all of the first subfield 1SF, the second subfield 2SF and the third subfield 3F, a grayscale value 6 times higher than that in the case of driving only the third subfield 3SF may be displayed.

Figure 12:
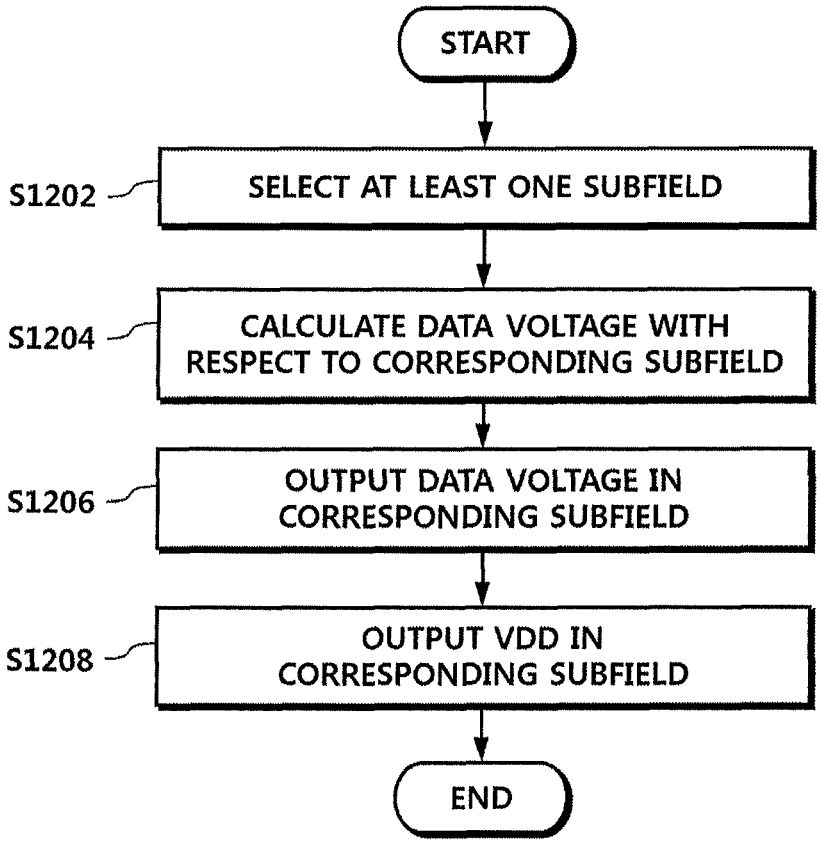
FIG. 12 is a flowchart illustrating the hybrid driving manner according to the third exemplary embodiment.

FIG. 12 is a flowchart illustrating the hybrid driving manner according to the third exemplary embodiment.

Referring to FIG. 12, the display apparatus 200 selects at least one subfield displayed according to the grayscale area including the grayscale value of the image (S1202). For example, referring to FIG. 11, when the grayscale value of the image corresponds to a highest grayscale, all of the first subfield 1SF, the second subfield 2SF and the third subfield 3SF are selected. In contrast, when the grayscale of the image corresponds to a lowest grayscale, only the third subfield 3SF is selected. Hereinafter, an example of the case wherein the grayscale value of the image corresponds to the highest grayscale is described.

Next, the display apparatus 200 calculates the data voltage corresponding to the corresponding grayscale value in the corresponding subfield through the gamma curve table (S1204). At this time, when the grayscale value corresponding to the highest grayscale is displayed, the first subfield 1SF selects a data voltage corresponding to a maximum value of the corresponding grayscale area by emitting at the highest level, and the second subfield 2SF also selects a data voltage corresponding to a maximum value of the corresponding grayscale area by emitting at the highest level. In addition, the third subfield 3SF calculates the data voltage corresponding to the corresponding grayscale value through the gamma curve table of the corresponding subfield.

When the subfield to be output and the data voltage are determined, the display apparatus 200 selects the subfield in which the data voltage is output, and may output the data voltage in the corresponding subfield (S1206). Next, the display apparatus 200 provides the high potential voltage VDD corresponding to the grayscale area of the corresponding subfield (S1208).

A fourth exemplary embodiment is described with reference to FIGS. 13 to 16.

Figure 13:
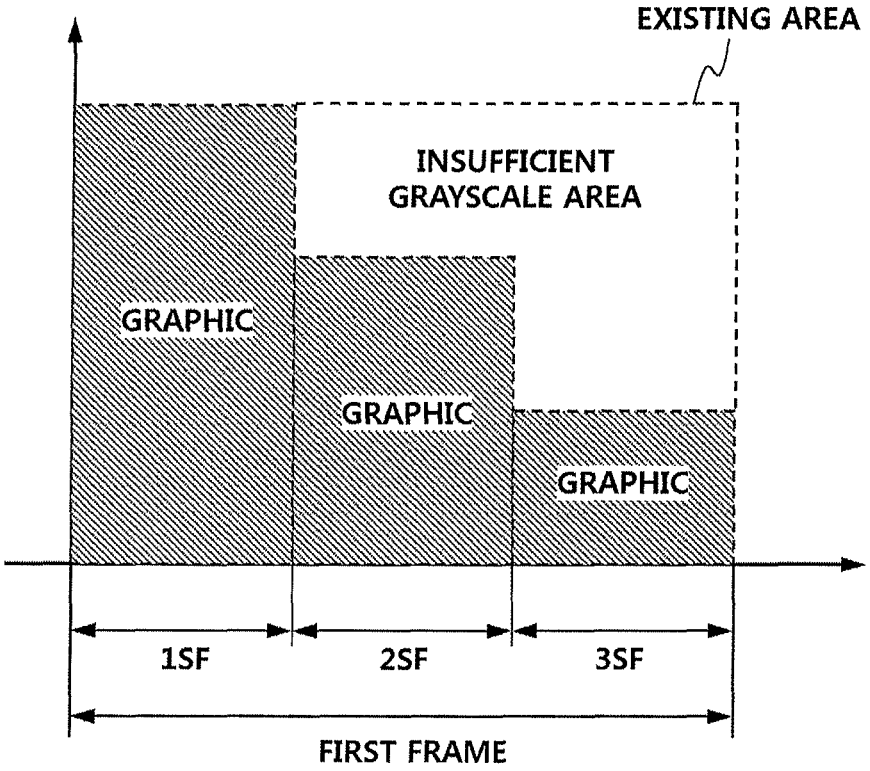
FIG. 13 is a view for describing an insufficient grayscale area compared to a single frame driving.

FIG. 13 is a view for describing an insufficient grayscale area compared to a single frame driving.

When it is assumed that the first subfield 1SF among the three subfields controls to enable the light emitting diode OLED to have a highest luminance, and a highest luminance of the first subfield 1SF is identical to a highest luminance of the first subfield 1SF in the conventional single frame driving, and in a case wherein the grayscale areas displayed in the three subfields are sequentially decreased as shown in FIG. 13, the grayscale values of the grayscale areas are smaller than the grayscale values of the grayscale areas (hereinafter referred to as an "existing area") displayed in a conventional single frame driving. Here, the grayscale value is lowered in correspondence to an area expressed as an insufficient grayscale area in FIG. 13.

Figure 14:
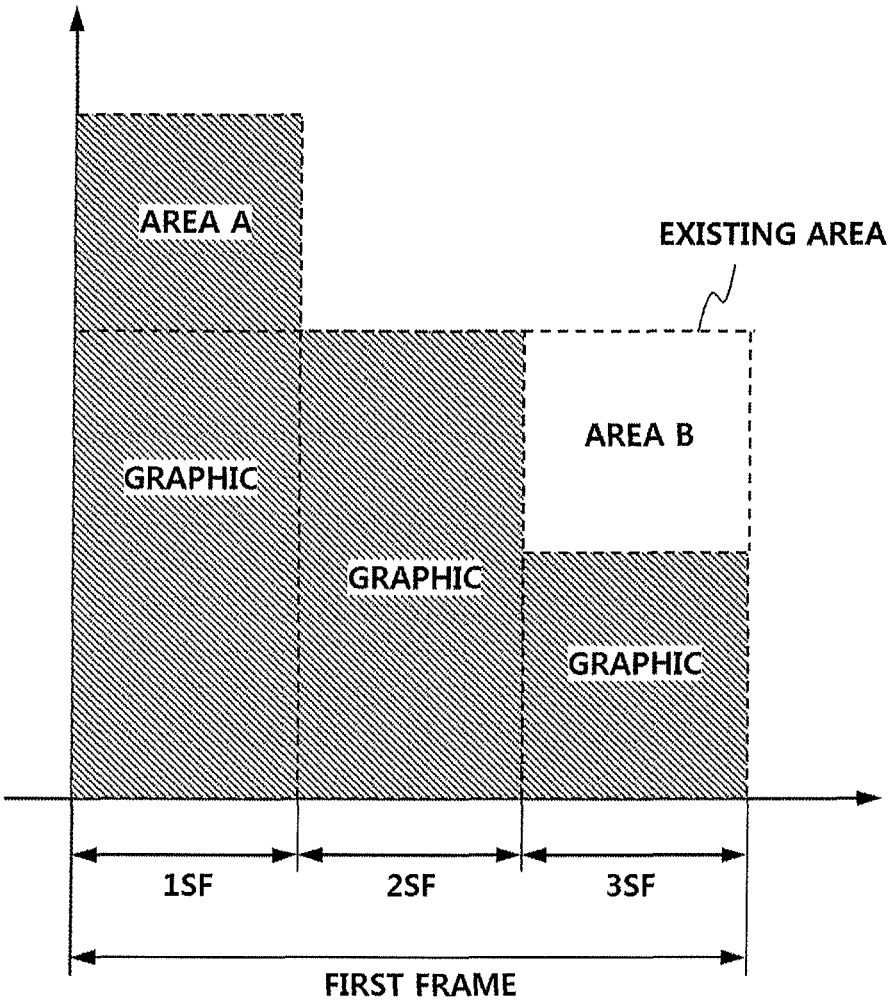
FIG. 14 is a first example view illustrating the subfield driving in a fourth exemplary embodiment.

FIG. 14 is a first example view illustrating the subfield driving in the fourth exemplary embodiment.

Referring to FIG. 14, in order to supplement the insufficient grayscale area as shown in FIG. 13, the display apparatus 200 drives the organic light emitting diode OLED in the first subfield 1SF to a luminance higher than a luminance of the organic light emitting diode OLED in the case of the conventional single frame driving. When the display apparatus 200 controls the organic light emitting diode OLED in such a manner, an area A of the first subfield 1SF supplements an area B of the third subfield 3SF, and thus the display apparatus 200 generally has a grayscale area identical to the existing area.

Figure 15:
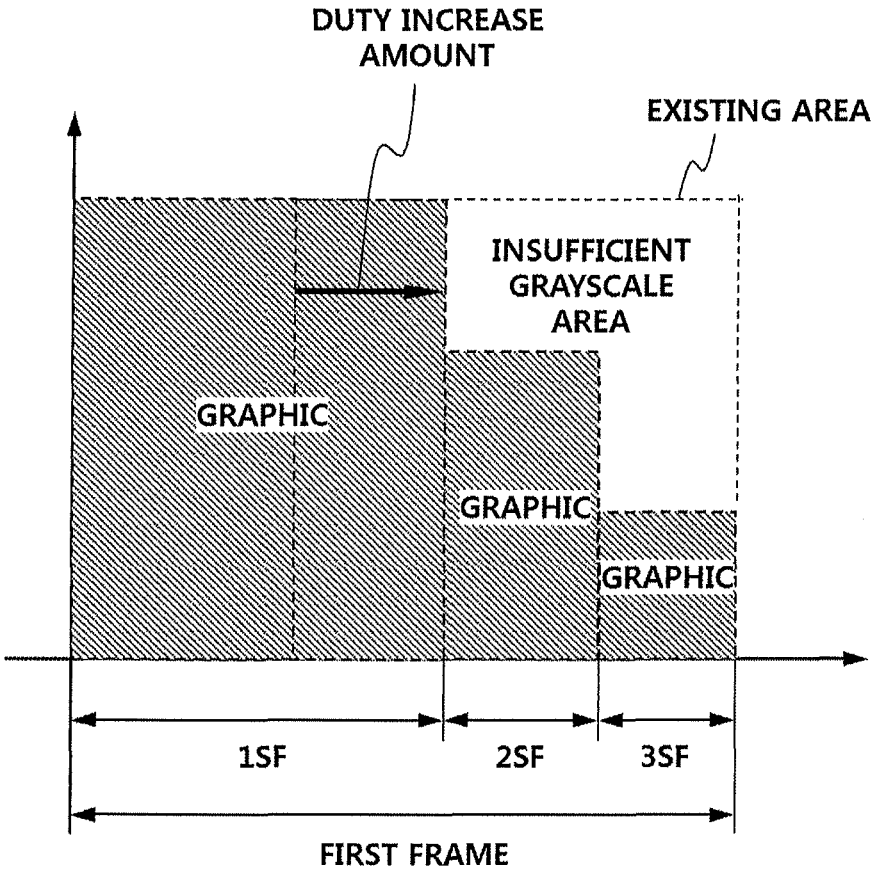
FIG. 15 is a second example view illustrating the subfield driving in the fourth exemplary embodiment.

FIG. 15 is a second example view illustrating the subfield driving in the fourth exemplary embodiment.

Referring to FIG. 15, the display apparatus 200 controls a duty of each of the subfields. Thus, at least two subfields may have duties different from each other.

When the display apparatus 200 increases the duty of the subfield (the first subfield 1SF in FIG. 15) displaying a largest grayscale area, the insufficient grayscale area is decreased compared to the existing area. The display apparatus 200 may decrease the insufficient grayscale area shown in FIG. 13 by increasing the duty of the subfield displaying the largest grayscale area as described above.

Figure 16:
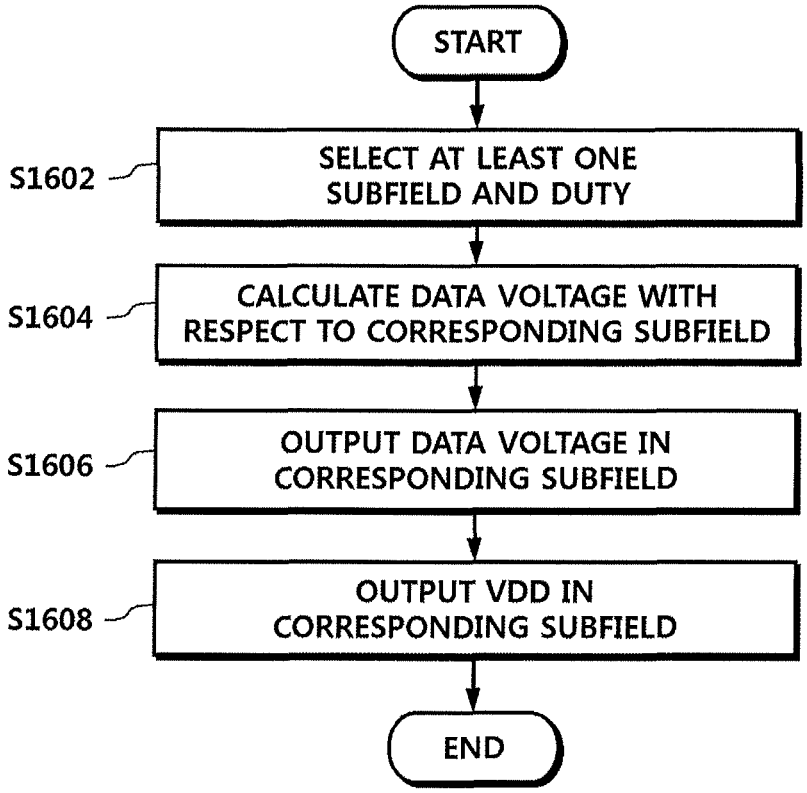
FIG. 16 is a flowchart illustrating the hybrid driving manner according to the fourth exemplary embodiment.

FIG. 16 is a flowchart illustrating the hybrid driving manner according to the fourth exemplary embodiment.

Referring to FIG. 16, the display apparatus 200 selects at least one subfield displayed according to the grayscale area including the grayscale value of the image (S1602). For example, referring to FIG. 15, when the grayscale value of the image corresponds to the highest grayscale, all of the first subfield 1SF, the second subfield 2SF and the third subfield 3SF are selected. But, at this time, when it is difficult to display the grayscale value although all of the subfields are selected (i.e. in the case wherein the insufficient grayscale area exists), the duty of the subfield (i.e. the first subfield 1SF in FIG. 15) displaying the largest grayscale area is increased enough to display the corresponding grayscale value.

Next, the display apparatus 200 calculates the data voltage corresponding to the corresponding grayscale value in the corresponding subfield through the gamma curve table (S1604). At this time, when the grayscale value corresponding to the highest grayscale is displayed, the first subfield 1SF selects the data voltage corresponding to the maximum value of the corresponding grayscale area by emitting at the highest level, and the second subfield 2SF also selects the data voltage corresponding to the maximum value of the corresponding grayscale area by emitting at the highest level. The third subfield 3SF calculates the data voltage corresponding to the corresponding grayscale value through the gamma curve table of the corresponding subfield.

Also, at this time, when the duty of the subfield (i.e. the first subfield 1SF in FIG. 15) displaying the largest grayscale area is increased, the display apparatus 200 selects the data voltage corresponding to the maximum value of the grayscale area corresponding to each of the subfields, in all of the subfields.

When the subfield to be output and the data voltage are determined, the display apparatus 200 selects the subfield in which the data voltage is output, and may output the data voltage in the corresponding subfield (S1606). Next, the display apparatus 200 provides the high potential voltage VDD corresponding to the grayscale area of the corresponding subfield (S1608).

A fifth exemplary embodiment is described with reference to FIGS. 17 to 19.

Figure 17:
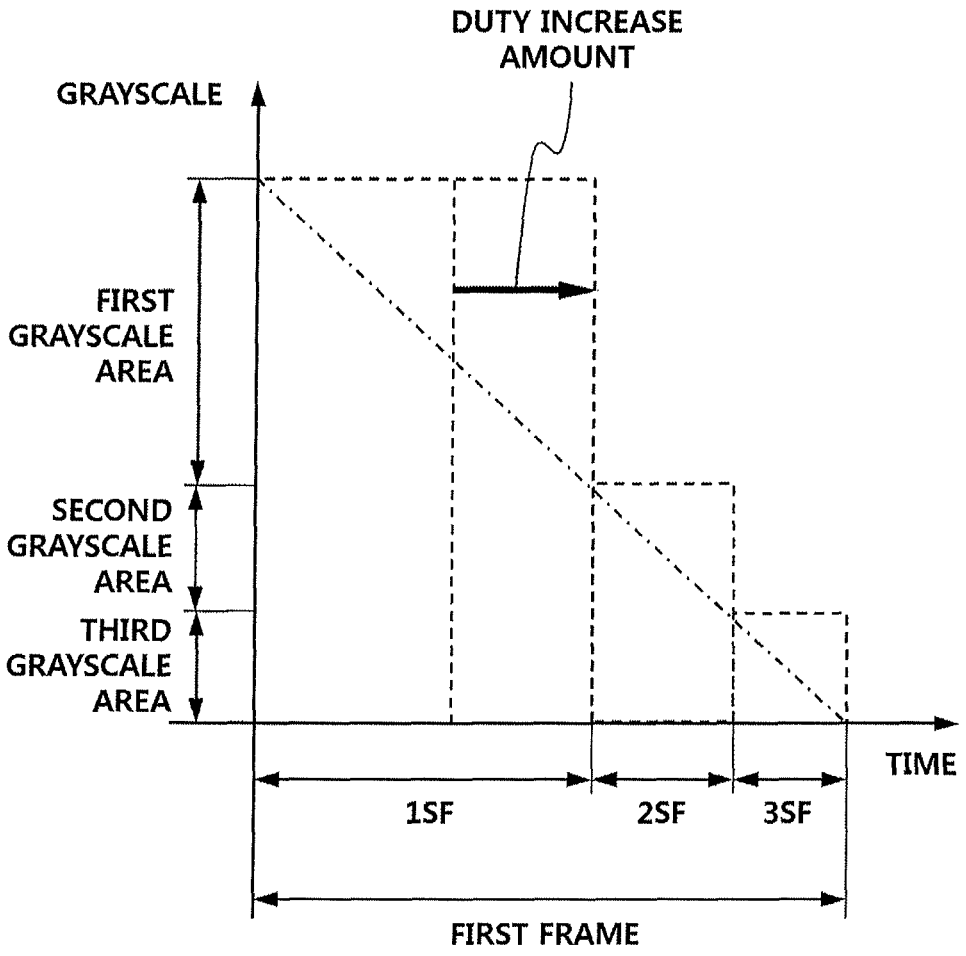
FIG. 17 is illustrates that a first grayscale area is larger according to an increase of a duty of a first subfield.

FIG. 17 is illustrates that the first grayscale becomes larger according to an increase of the duty of the first subfield. FIG. 18 illustrates that the drain-source voltage of a point P becomes lower as the first grayscale area becomes larger.

Referring to FIG. 17, the first grayscale area displayed through the first subfield 1SF becomes larger according to an increase of the duty of the first subfield 1SF.

Figure 18:
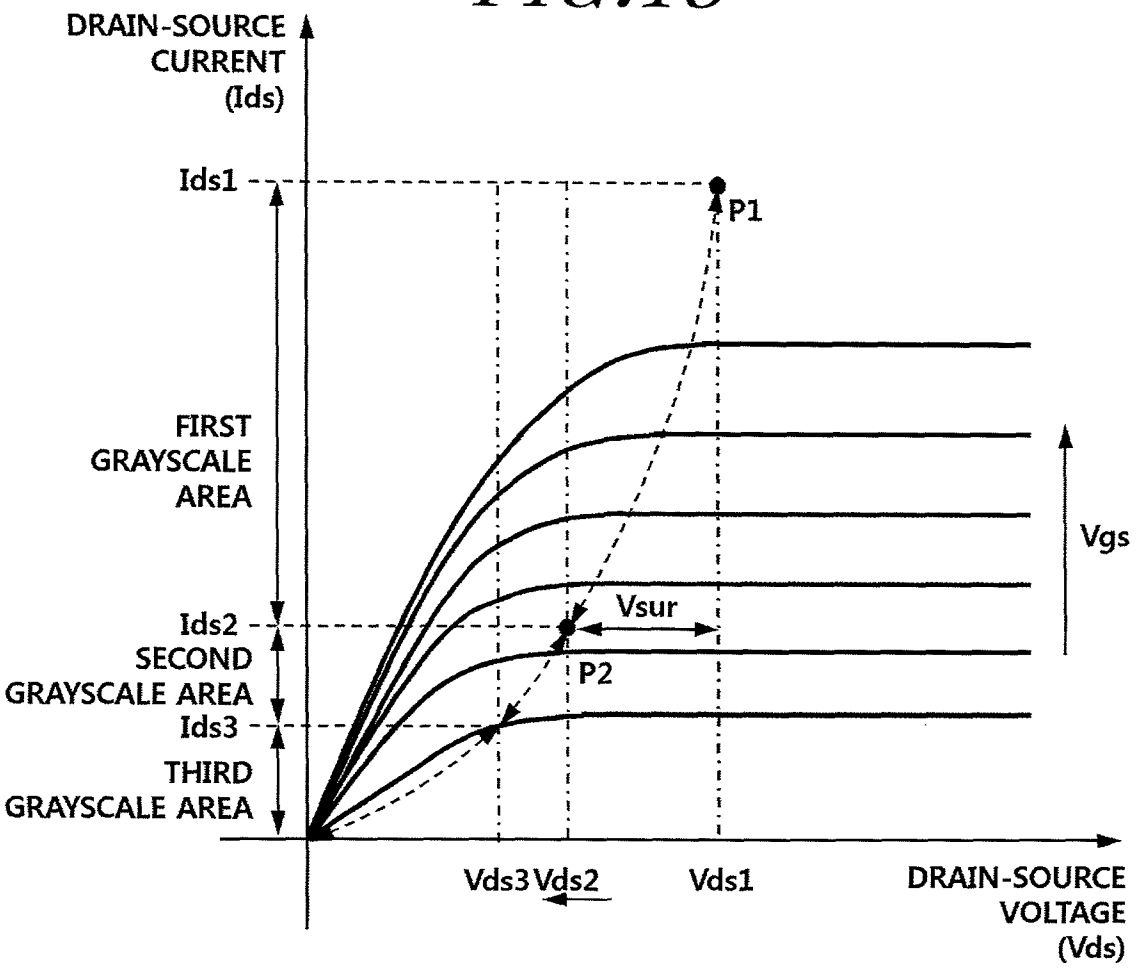
FIG. 18 illustrates that a drain-source voltage of a point P2 becomes lower as the first grayscale area becomes larger.

Referring to FIG. 18, a difference voltage Vsur between a drain-source voltage Vds1 of a saturation point P1 for displaying a maximum grayscale value of the first grayscale area and a drain-source voltage Vds2 of a saturation point P2 for displaying a minimum grayscale value of the first grayscale area becomes larger as the first grayscale area becomes larger. Thus, in a case wherein the display apparatus 200 maintains the same high potential voltage VDD in the first subfield 1SF displaying the first grayscale area, when the minimum grayscale value is displayed, a loss calculated by (Ids2 A*Vsur V) is further generated.

The more the duty of the first subfield 1SF is increased, the larger the first grayscale area becomes, and the larger the first grayscale area becomes, the larger the loss calculated by (Ids2 A*Vsur V) becomes.

Thus, when the grayscale value of the image is larger than a certain reference value, the display apparatus 200 may drive the corresponding frame in the single frame driving manner rather than the hybrid driving manner.

Figure 19:
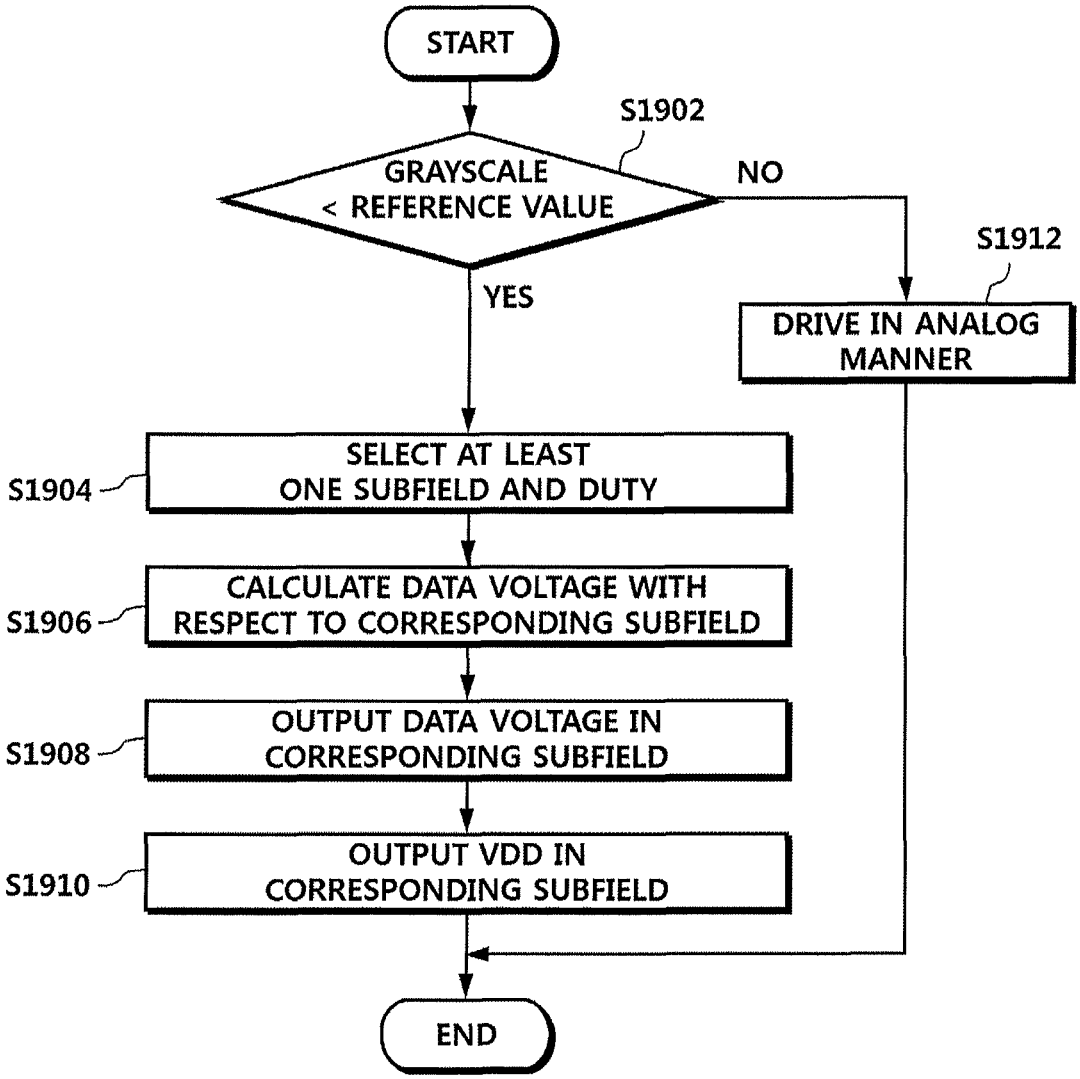
FIG. 19 is a flowchart illustrating the hybrid driving manner according to the fifth exemplary embodiment.

FIG. 19 is a flowchart illustrating the hybrid driving manner according to the fifth exemplary embodiment.

Referring to FIG. 19, the display apparatus 200 determines whether the grayscale value of the image to be displayed is smaller than the certain reference value (S1902).

When the grayscale value of the image to be displayed is smaller than the certain reference value (YES in S1902), the display apparatus 200 drives the corresponding frame in the hybrid driving manner.

According to the hybrid driving manner, the display apparatus 200 selects at least one of the grayscale areas to be displayed according to the grayscale area including the grayscale value of the image, and when it is difficult to display the grayscale value although all of the subfields are selected (i.e. in the case wherein the insufficient grayscale area exists), the display apparatus 200 increases the duty of the subfield displaying the largest grayscale area enough to display the corresponding grayscale value.

Next, the display apparatus 200 calculates the data voltage corresponding to the corresponding grayscale value in the corresponding subfield through the gamma curve table (S1906).

When the subfield to be output and the data voltage are determined, the display apparatus 200 selects the subfield in which the data voltage is output, and may output the data voltage in the corresponding subfield (S1908). Next, the display apparatus 200 provides the high potential voltage VDD corresponding to the grayscale area of the corresponding subfield (S1910).

When the grayscale value of the image to be displayed is equal to or larger than the certain reference value (NO in S1902), the display apparatus 200 drives the corresponding frame in the analog driving manner. The display apparatus 200 calculates the data voltage in the corresponding frame unit, and provides the data voltage through the data line in the corresponding frame.

In the above, several exemplary embodiments of the preset invention are described. According to the exemplary embodiments described above, the display apparatus 200 may display the one frame with the plurality of subfields. In addition, the display apparatus 200 may lower power consumption by providing the high potential voltage or the low potential voltage differently according to each of the subfields.

Further, the terms "includes", "constitutes", or "has" mentioned above mean that a corresponding structural element is included unless they have no reverse meaning. Accordingly, it should be interpreted that the terms may not exclude but further include other structural elements. All the terms that are technical, scientific or otherwise agree with the meanings as understood by a person skilled in the art unless defined to the contrary. Common terms as found in dictionaries should be interpreted in the context of the related technical writings not too ideally or impractically unless the present disclosure expressly defines them so.

Although the embodiments of the present invention have been described for illustrative purposes, those skilled in the art will appreciate that various modifications, additions and substitutions are possible, without departing from the scope and spirit of the invention. Accordingly, the embodiments disclosed in the present invention are merely to not limit but describe the technical spirit of the present invention. Further, the scope of the technical spirit of the present invention is limited by the embodiments. The scope of the present invention shall be construed on the basis of the accompanying claims in such a manner that all of the technical ideas included within the scope equivalent to the claims belong to the present invention.

What is claimed is:

1. An Organic Light Emitting Diode (OLED) display apparatus displaying a frame of an image having a grayscale value with N (N is a natural number larger than 2) number of subfields, the OLED display apparatus comprising:

a display panel where pixels are defined by an intersection of data lines and gate lines;

a power supplying unit that provides a voltage to a driving transistor and an OLED of the pixel;

a gate driving unit that provides a scan signal to the gate line; and a data driving unit that controls a data voltage in an analog manner, the data voltage provided to the data line in a subfield, wherein each of the subfields has an associated power supply voltage, and the data voltage is applied to a pixel in least one subfield of the N subfields based on the grayscale value of the image; and wherein the displayed grayscale of a pixel is a sum of the grayscales of the N subfields and when the grayscale of the image is greater than the sum of the grayscales of the pixel of the N subfields, the data voltage of the pixel in at least one of the subfields in increased; or, when the increase in the data voltage is insufficient to achieve the grayscale of the image, the duration of one of the subfields increased.

2. The OLED display apparatus of claim 1, wherein N successive grayscale areas are assigned to the subfields respectively, and the grayscale areas displayed in all of the subfields are different.

3. The OLED display apparatus of claim 2, wherein the data driving unit provides a black data voltage to at least (N−1) number of the subfields.

4. The OLED display apparatus of claim 1, wherein the power supplying unit provides the high potential voltage or the low potential voltage so that a driving transistor connected to the OLED is driven in a saturation area, and controls to decrease a drain-source voltage of the driving transistor.

5. The OLED display apparatus of claim 4, wherein the power supplying unit provides the high potential voltage or the low potential voltage so that the drain-source voltage of the driving transistor is lower in a second subfield than the drain-source voltage of the driving transistor in a first subfield, when an area of a grayscale value higher than a grayscale value of an area displayed in the second subfield is displayed in the first subfield.

6. The OLED display apparatus of claim 1, wherein the power supplying unit does not provide the high potential voltage or the low potential voltage in at least one subfield.

* * * * *